US011096527B2

(12) United States Patent
Bice

(10) Patent No.: US 11,096,527 B2
(45) Date of Patent: Aug. 24, 2021

(54) ILLUMINATED SHOWER HANDLE ASSEMBLY

(71) Applicant: John Bice, Frankfort, KY (US)

(72) Inventor: John Bice, Frankfort, KY (US)

( * ) Notice: Subject to any disclaimer, the term of this patent is extended or adjusted under 35 U.S.C. 154(b) by 5 days.

(21) Appl. No.: 16/728,579

(22) Filed: Dec. 27, 2019

(65) Prior Publication Data

US 2021/0196084 A1 Jul. 1, 2021

(51) Int. Cl.

| | |
|---|---|
| ***A47K 3/28*** | (2006.01) |
| ***F21V 23/04*** | (2006.01) |
| ***F21V 33/00*** | (2006.01) |

(52) U.S. Cl.

CPC ..... *A47K 3/281* (2013.01); *F21V 23/0442* (2013.01); *F21V 33/0004* (2013.01)

(58) Field of Classification Search

CPC .. A47K 3/281; F21V 23/0442; F21V 33/0004
See application file for complete search history.

(56) References Cited

U.S. PATENT DOCUMENTS

| | | | | |
|---|---|---|---|---|
| 4,367,517 | A | 1/1983 | Balzar | |
| 6,390,647 | B1 * | 5/2002 | Shaefer | F21S 8/035 362/276 |
| 6,601,247 | B2 | 8/2003 | Shimizu | |
| 6,894,434 | B1 * | 5/2005 | Kosoff | A61M 21/02 315/134 |
| 8,028,355 | B2 | 10/2011 | Reeder | |
| 2003/0189127 | A1 | 10/2003 | Arendt | |
| 2004/0062047 | A1 * | 4/2004 | Camarota | A47K 3/003 362/399 |
| 2005/0285547 | A1 * | 12/2005 | Piepgras | H05B 45/20 315/294 |
| 2008/0080173 | A1 | 4/2008 | Trimble | |
| 2008/0271238 | A1 * | 11/2008 | Reeder | A46B 7/04 4/597 |
| 2010/0141153 | A1 * | 6/2010 | Recker | H05B 47/115 315/149 |
| 2010/0277295 | A1 * | 11/2010 | Matthews | F21L 4/027 340/332 |
| 2017/0016612 | A1 * | 1/2017 | Boyd | G08B 13/19697 |
| 2018/0135849 | A1 * | 5/2018 | Paseta | A47K 3/38 |
| 2018/0306429 | A1 * | 10/2018 | Rosko | F21S 10/002 |
| 2019/0090056 | A1 * | 3/2019 | Rexach | G06F 3/167 |
| 2020/0120310 | A1 * | 4/2020 | Chien | F21V 29/00 |

* cited by examiner

*Primary Examiner* — Tsion Tumebo

(57) ABSTRACT

An illuminated shower handle assembly for dimly illuminating a bathroom at night includes a handle that is positionable in a recess of a shower stall in a residential bathroom. The handle can be gripped during showering and the handle is comprised of a translucent material. A light emitter is integrated into the handle and the light emitter illuminates the handle when the light emitter is turned on. In this way the handle acts as a night light for dimly illuminating the residential bathroom at night.

4 Claims, 4 Drawing Sheets

ILLUMINATED SHOWER HANDLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shower handle devices and more particularly pertains to a new shower handle device for dimly illuminating a bathroom at night.

(2) Description of Related Art Including Information Disclosed Under 37 CFR 1.97 and 1.98

The prior art relates to shower handle devices. The prior art discloses a shower stall that has a light emitter being embedded into a wall of the shower stall. The prior art also discloses an illuminated hand rail bracket for mounting a handrail to a wall and providing light. The prior art discloses a bathtub that has optical fibers being integrated therein for emitting light. Additionally, the prior art discloses a shower stall that includes a variety of environmental sensors for sensing environmental conditions in a bathroom. The prior art discloses an illuminated rod standoff for mounting a rod to a surface and for emitting light. Lastly, the prior art discloses an illuminated grab bar that includes a pair of light emitters and a pair of power supplies.

BRIEF SUMMARY OF THE INVENTION

An embodiment of the disclosure meets the needs presented above by generally comprising a handle that is positionable in a recess of a shower stall in a residential bathroom. The handle can be gripped during showering and the handle is comprised of a translucent material. A light emitter is integrated into the handle and the light emitter illuminates the handle when the light emitter is turned on. In this way the handle acts as a night light for dimly illuminating the residential bathroom at night.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
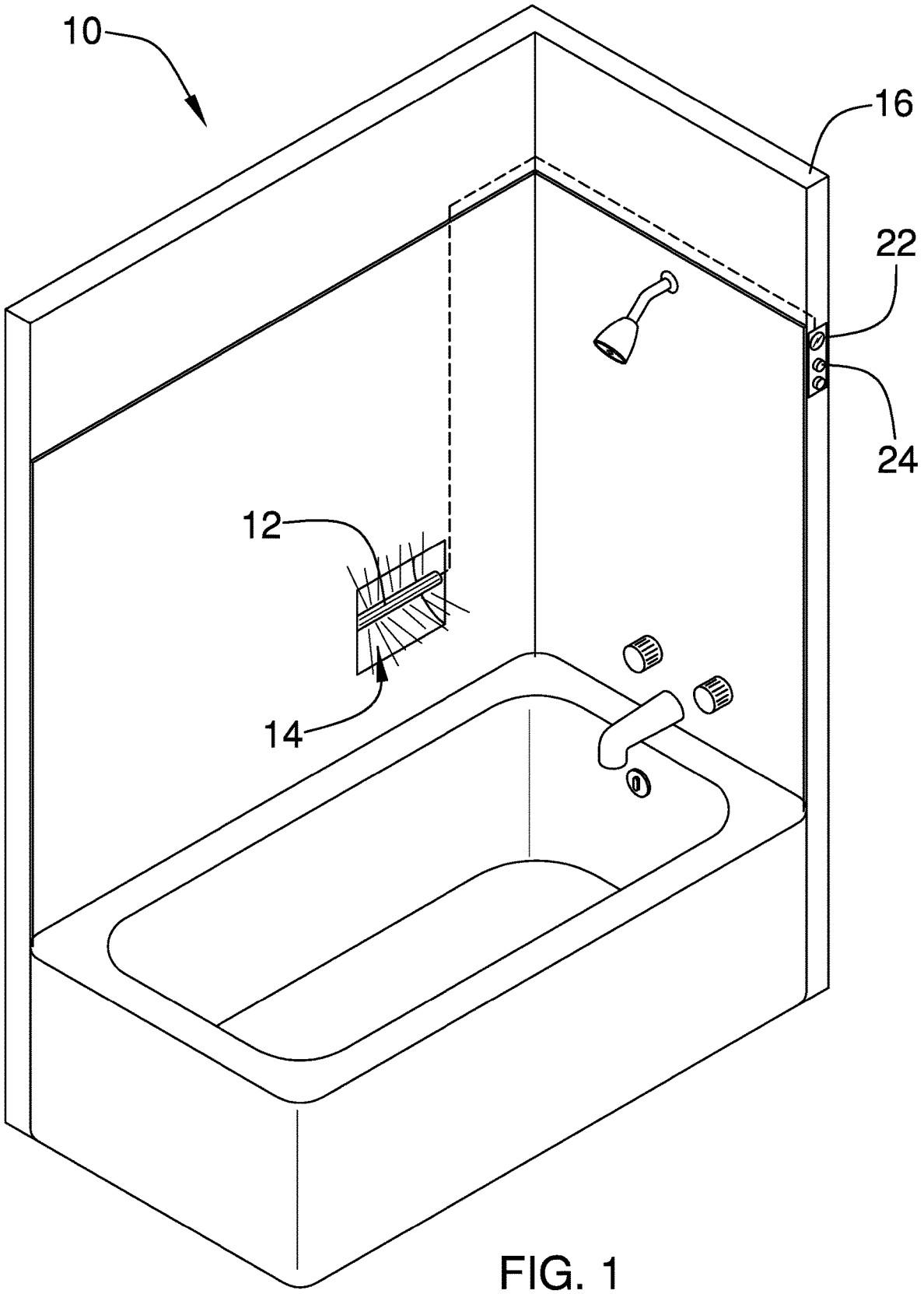
FIG. 1 is a perspective in-use view of an illuminated shower handle assembly according to an embodiment of the disclosure.
Figure 2:
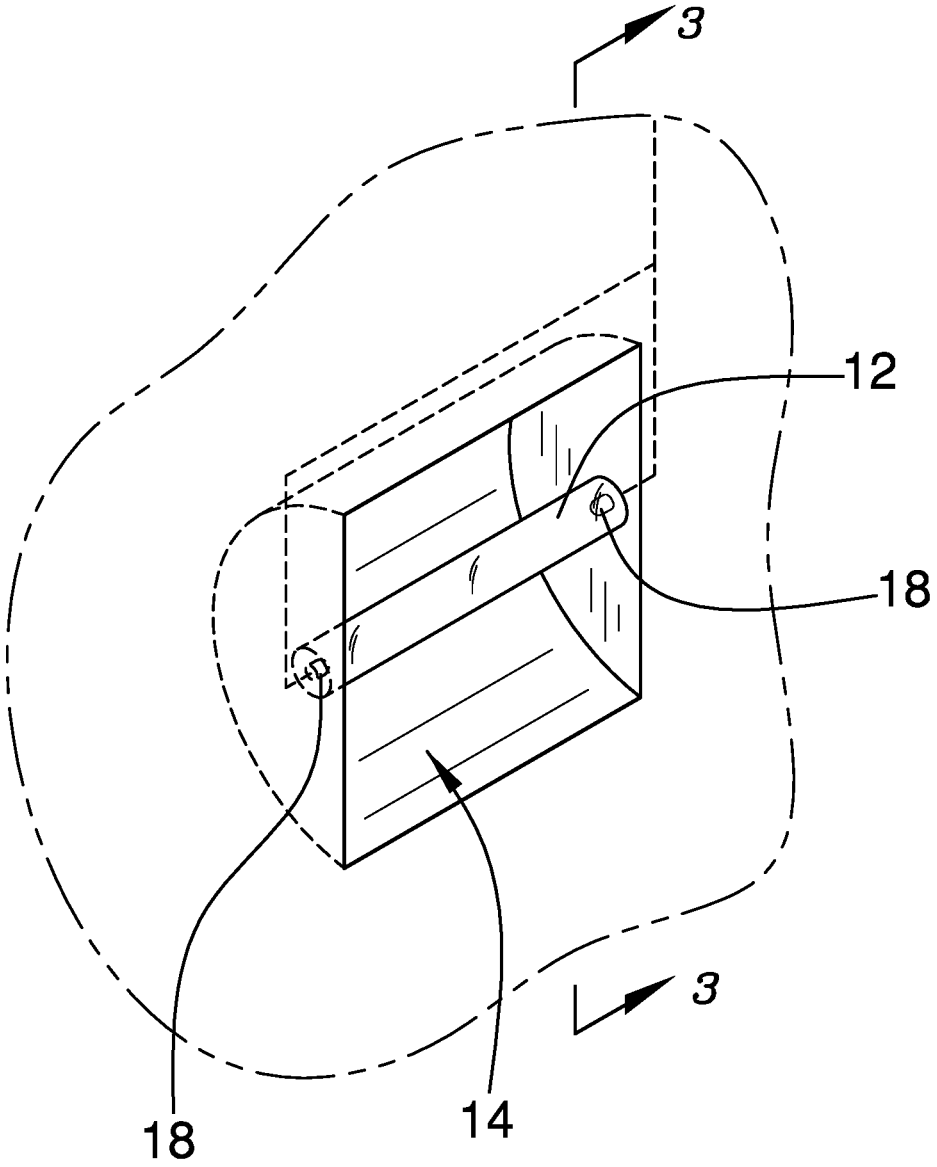
FIG. 2 is a detail view of a handle in a shower stall recess of an embodiment of the disclosure.
Figure 3:
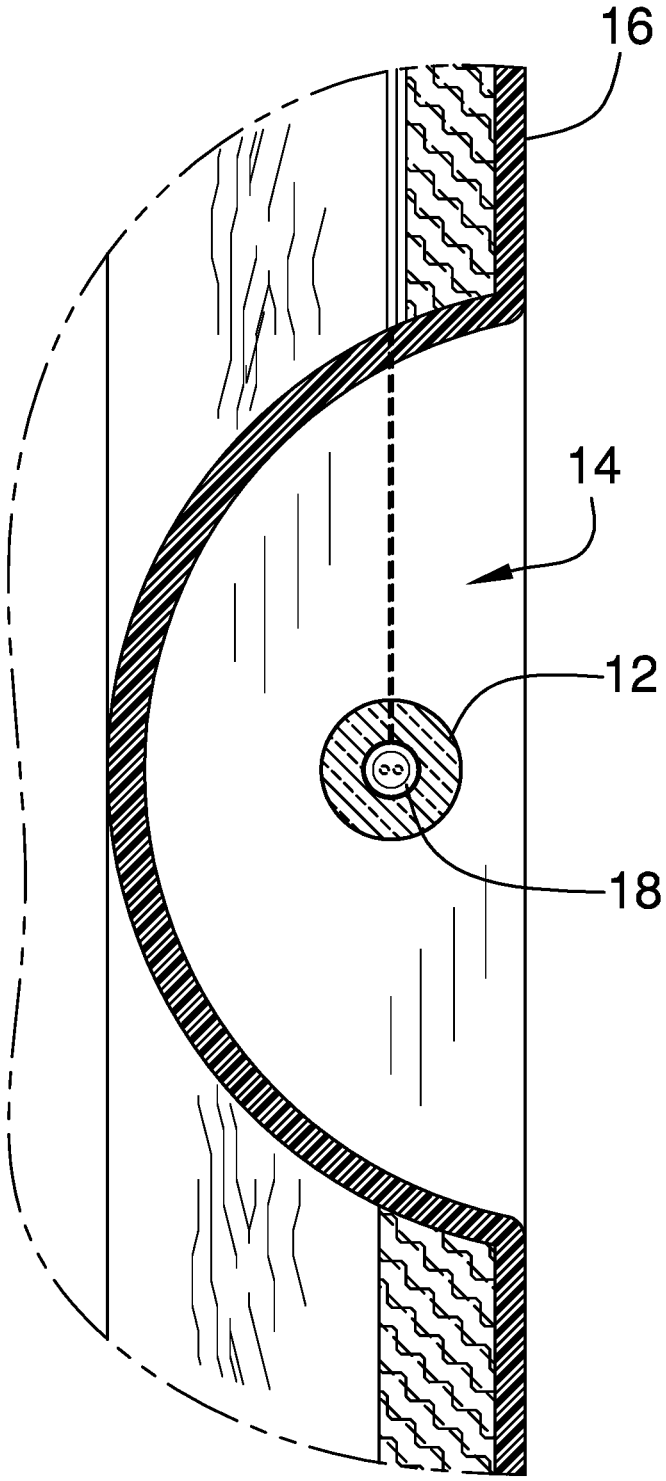
FIG. 3 is a cross sectional view taken along line 3-3 of FIG. 2 of an embodiment of the disclosure.
Figure 4:
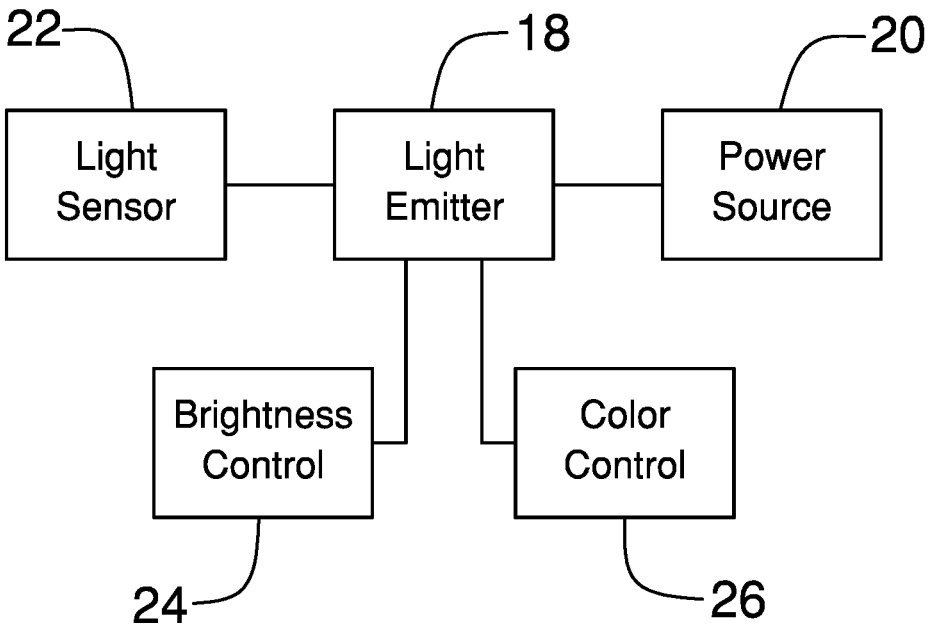
FIG. 4 is a schematic view of an embodiment of the disclosure.

With reference now to the drawings, and in particular to FIGS. 1 through 4 thereof, a new shower handle device embodying the principles and concepts of an embodiment of the disclosure and generally designated by the reference numeral 10 will be described.

As best illustrated in FIGS. 1 through 4, the illuminated shower handle assembly 10 generally comprises a handle 12 that is positionable in a recess 14 of a shower stall 16 in a residential bathroom. The handle 12 is gripped by a user during showering and the handle 12 is comprised of a translucent material. The shower stall 16 may be a residential shower stall of any conventional design.

A light emitter 18 is provided and the light emitter 18 is integrated into the handle 12. The light emitter 18 illuminates the handle 12 when the light emitter 18 is turned on. In this way the handle 12 can act as a night light. The light emitter 18 is electrically coupled to a power source 20 comprising the electrical wiring in the residential bathroom. Additionally, the light emitter 18 may comprise an LED or the like and the light emitter 18 may emit a sufficiently low intensity of light for the use as a night light. The light emitter 18 may emit many different colors of light.

A light sensor 22 is coupled to the shower stall 16 to sense ambient light in the residential bathroom and the light sensor 22 is electrically coupled to the light emitter 18. The light emitter 18 is turned on when the light sensor 22 senses a minimum intensity of ambient light. Conversely, the light emitter 18 is turned off when the light sensor 22 senses a greater intensity of ambient light than the minimum intensity. The light sensor 22 may be an electronic light sensor of any conventional design.

A brightness control 24 is rotatably coupled to the shower stall 16 and the brightness control 24 is electrically coupled to the light emitter 18. The brightness control 24 adjusts the brightness of the light emitter 18 when the light emitter 18 is turned on. The shower stall 16 may be manufactured with the light emitter 18, the light sensor 22 and the brightness control 24 as integrated components of the shower stall 16. Alternatively, the handle 12 having the light emitter 18, the light sensor 22 and the brightness control 24 may be retrofitted into an existing shower stall 16. A color control 26 may be rotatably coupled to the shower stall 16 and the color control 26 may be electrically coupled to the light emitter 18 for changing the color of light emitted by the light emitter 18.

In use, the light emitter 18 is turned on when the light sensor 22 senses the minimum intensity of ambient light. Thus, the light emitter 18 dimly illuminates the residential bathroom to facilitate a user to be able to see when the user enters the residential bathroom at night. Moreover, the light emitter 18 emits an intensity of light that is sufficiently low to avoid fully waking the user when the user enters the residential bathroom at night. The brightness control 24 is adjusted to set the light emitter 18 at a desired level of intensity.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated shower handle assembly being configured to act as night light in a residential bathroom, said assembly comprising:

a handle being positioned in a recess of a shower stall in a residential bathroom wherein said handle is configured to be gripped by a user during showering, said handle being comprised of a translucent material;

a light emitter being integrated into said handle, said light emitter illuminating said handle when said light emitter is turned on wherein said handle is configured to act as a night light for dimly illuminating the residential bathroom at night, said light emitter being electrically coupled to a power source comprising an electrical wiring in the residential bathroom; and a light sensor being coupled to the shower stall and positioned on a surface of the shower stall such that the light sensor is facing away from the shower stall wherein the light sensor is configured to sense ambient light in the residential bathroom outside of the shower stall, said light sensor being electrically coupled to said light emitter.

2. The assembly according to claim 1, wherein said light emitter being turned on when said light sensor senses a minimum intensity of ambient light, said light emitter being turned off when said light sensor senses a greater intensity of ambient light than the minimum intensity.

3. The assembly according to claim 1, further comprising a brightness control being rotatably coupled to the shower stall, said brightness control adjusting the brightness of said light emitter when said light emitter is turned on, said brightness control being electrically coupled to said light emitter.

4. An illuminated shower handle assembly being configured to act as night light in a residential bathroom, said assembly comprising:

a handle being positionable in a recess of a shower stall in a residential bathroom wherein said handle is configured to be gripped by a user during showering, said handle being comprised of a translucent material;

a light emitter being integrated into said handle, said light emitter illuminating said handle when said light emitter is turned on wherein said handle is configured to act as a night light for dimly illuminating the residential bathroom at night, said light emitter being electrically coupled to a power source comprising an electrical wiring in the residential bathroom;

a light sensor being coupled to the shower stall and positioned on a surface of the shower stall such that the light sensor is facing away from the shower stall wherein the light sensor is configured to sense ambient light in the residential bathroom outside of the shower stall, said light sensor being electrically coupled to said light emitter, said light emitter being turned on when said light sensor senses a minimum intensity of ambient light, said light emitter being turned off when said light sensor senses a greater intensity of ambient light than the minimum intensity; and a brightness control being rotatably coupled to the shower stall, said brightness control adjusting the brightness of said light emitter when said light emitter is turned on, said brightness control being electrically coupled to said light emitter.

* * * * *